US006779472B1

(12) United States Patent
Green et al.

(10) Patent No.: US 6,779,472 B1
(45) Date of Patent: Aug. 24, 2004

(54) HOSIERY TOE CLOSING APPARATUS AND METHOD

(75) Inventors: David H. Green, High Point, NC (US); Gilbert H. Hine, Jr., Kernersville, NC (US)

(73) Assignee: Sara Lee Corporation, Winston-Salem, NC (US)

( * ) Notice: Subject to any disclaimer, the term of this patent is extended or adjusted under 35 U.S.C. 154(b) by 0 days.

(21) Appl. No.: 10/396,666

(22) Filed: Mar. 25, 2003

(51) Int. Cl.[7] ..... D05B 21/00
(52) U.S. Cl. ..... 112/475.12; 112/470.15
(58) Field of Search ..... 112/475.12, 470.08, 112/470.15, 470.33, 449, 462, 464, 315, 260, 441, 288

(56) References Cited

U.S. PATENT DOCUMENTS

| | | | | | |
|---|---|---|---|---|---|
| 3,090,963 | A | * | 5/1963 | Wittman | 2/239 |
| 3,648,634 | A | * | 3/1972 | Van Hazendonk | 112/292 |
| 3,834,332 | A | * | 9/1974 | Gude | 112/444 |
| 3,875,880 | A | | 4/1975 | Hazelgrove et al. | |
| 4,020,775 | A | | 5/1977 | King et al. | |
| 4,133,280 | A | | 1/1979 | Takatori et al. | |
| 4,609,419 | A | | 9/1986 | Hodges | |
| 4,903,621 | A | | 2/1990 | Hodges | |
| 5,014,634 | A | | 5/1991 | Hodges et al. | |
| 5,207,165 | A | | 5/1993 | Gazzarrini | |
| 5,241,918 | A | * | 9/1993 | Hayes | 112/7 |
| 5,398,626 | A | * | 3/1995 | Rosso et al. | 112/470.15 |
| 6,026,757 | A | | 2/2000 | Valle et al. | |
| 6,070,541 | A | * | 6/2000 | Kinoshita et al. | 112/162 |
| 6,167,825 | B1 | * | 1/2001 | Marchetti | 112/162 |
| 6,213,038 | B1 | * | 4/2001 | Sahl | 112/260 |

* cited by examiner

*Primary Examiner*—Ismael Izaguirre
(74) *Attorney, Agent, or Firm*—Kilpatrick Stockton LLP

(57) ABSTRACT

An apparatus and method for closing the toe of a hosiery blank includes a hosiery toe closing machine including a sewing head having a sewing needle and a toe seam width guide. The toe seam width guide has a maximum thread guide width greater than 5 mm, preferably in the range of 6–10 mm. When the sewing needle pulls a thread around the maximum thread guide width of the toe seam width guide, the hosiery toe is closed with a wide, visible seam. The hosiery toe closing machine can include a first sewing head having a maximum thread guide width of 5 mm, for sewing a first, narrow seam, and a second sewing head having a maximum thread guide width greater than 5 mm, allowing a second seam that is wider than the first seam to be sewn over the first seam. The toe seam width guides are adjustably attached to the sewing heads for adjusting the effective thread guide width in the respective sewing heads and thereby provide corresponding adjustments to the relative widths of the first and second seams.

30 Claims, 7 Drawing Sheets

HOSIERY TOE CLOSING APPARATUS AND METHOD

FIELD OF THE INVENTION

The present invention relates to an apparatus and method for hosiery toe closing. Embodiments of the present invention are advantageous for providing wide hosiery toe seams that are strong and easily visible.

BACKGROUND OF THE INVENTION

In some garments, whether a seam is visible is not a major concern. In other garments, however, it is desirable for a seam to be easily seen by a consumer. For example, a visible seam can be used to guide a wearer as to the proper orientation of a garment for donning the garment. The toe seam on the "top" side of a sock, for example, can quickly reveal which side of the sock is "up" and thus how to orient the sock to place it on one's foot. Seams having a distinct appearance and that can be easily seen are used as part of the fashion design of a garment. Distinctive, readily visible seams are increasingly used as a means of brand recognition, and thus have important commercial value.

In addition, particular colors of threads used in seams, such as in a sock toe seam, can be used to indicate the consumer group for which the socks are made. For example, pink sock toe seams can indicate socks made for girls, and blue sock toe seams can indicate socks made for boys. Threads sewn into sock toe seams can include a single color or a combination of colors coordinated to match the colors of a school or sports team. Accordingly, the visibility of selected seams in particular garments is important.

Much of the garment sewing by textile manufacturers today is done with automated sewing machinery. For example, as much as 90 percent or more of socks are made using automated, high-speed sewing machines. Use of automated sewing machinery allows the ability to sew within tolerance zones, to apply statistical process control, and to sense errors, among other programmable process features. These features are particularly important as the market moves toward smaller lot sizes, and individual garment customization.

In automated sewing of textile products, threads smaller than those typically used in hand sewing are often utilized. As a result, seams made in automated sewing processes are generally less capable of being seen than hand-sewn seams. When the threads used to sew two pieces of fabric together, and thereby form a seam, are the same color as the yarn in the fabric, the seam is even less recognizable. Consequently, seams in textile products made on conventional automatic sewing machines are often essentially hidden from view.

Thus, there is a need for a means to sew easily visible seams in textile products. Many textile products are manufactured and sold with increasingly small margins of profit. As such, there is also a need to provide a means for sewing easily visible seams using conventional automated sewing equipment and that is cost-effective.

SUMMARY OF THE INVENTION

The present invention provides an apparatus and method for producing a wide seam in textile products. Embodiments of the present invention are advantageous for closing the toe of a hosiery blank with a wide, visible, and strong seam.

For example, an apparatus for producing a wide seam includes a sewing device including a sewing head having a sewing needle, and a seam width guide attached to the sewing head. The seam width guide has a maximum thread guide width sufficient to produce a wide seam. When the sewing needle pulls a thread around the maximum thread guide width of the seam width guide, a wide, visible seam is produced. The seam width guide is adjustably attached to the sewing head for adjusting an effective thread guide width over which the sewing needle pulls the thread for correspondingly adjusting the width of a resulting seam. In such an apparatus, the sewing device can further include a first sewing head having a first maximum thread guide width, for sewing a first seam. A second sewing head has a maximum thread guide width greater than the first maximum thread guide width, for sewing a second, wider seam over the first seam.

In an embodiment of the present invention, a hosiery toe closing apparatus includes a hosiery toe closing machine including a sewing head having a sewing needle and a toe seam width guide. The toe seam width guide has a maximum thread guide width greater than 5 mm. When the sewing needle pulls a thread around the maximum thread guide width of the toe seam width guide, the hosiery toe is closed with a wide, visible seam. In preferred embodiments, the maximum thread guide width comprises a width in the range of 6–10 mm. In most preferred embodiments, the maximum thread guide width is 7 mm.

The hosiery toe closing machine can include a first sewing head having a maximum thread guide width of 5 mm, for sewing a first, narrow seam. A second sewing head having a maximum thread guide width greater than 5 mm allows sewing a second seam over the first seam that is wider than the first scam. The maximum thread guide width of the second sewing head toe seam width guide is preferably in the range of 6–10 mm, and most preferably is a width of 7 mm. The hosiery toe closing machine seam width guides are adjustably attached to the sewing heads for adjusting an effective thread guide width over which a sewing needle pulls the thread. These adjustments provide corresponding adjustments to the first and second seams and thus to the relative widths of the first and second seams.

Such an apparatus is useful for closing the toe of a hosiery blank having a toe pouch with an edge and a hosiery top portion with an edge. In embodiments, use of an apparatus of the present invention allows the toe seam to be sewn into a course of yarn beyond the first two courses of yarn at the edges of the toe pouch and the hosiery top portion to provide a wider seam than in conventional toe closing machines. In addition, the second seam lies flat over the first seam. In embodiments, the second sewing head is positioned closer to a hosiery blank than the first sewing head to produce the second seam in a flat profile over the first seam.

Embodiments of an apparatus of the present invention include a hosiery blank alignment means for aligning the edge of the toe pouch and the edge of the hose top portion in juxtaposed relationship for sewing underneath a sewing head. In this manner, a straight seam can be produced at rapid rates in automated fashion. In an apparatus of the present invention, a hosiery toe closing machine can include a means for automatically conveying, or transporting, a hosiery blank between sewing heads and other operational stations on the machine.

Embodiments of the present invention include methods for closing a toe of a hosiery blank. In one embodiment, a method for closing a toe of a hosiery blank includes providing a hosiery toe closing machine having a sewing head including a sewing needle and a toe seam width guide. The toe seam width guide has a maximum thread guide width greater than 5 mm. Pulling a thread with the sewing needle around the maximum thread guide width of the toe seam width guide allows the hosiery toe to be closed with a wide, visible toe seam. In such methods, the maximum thread guide width is in the range of 6–10 mm, and preferably is 7 mm.

In other embodiments, a method of the present invention includes the steps of providing a hosiery toe closing machine comprising a hosiery blank conveyor means, a hosiery blank alignment means, a first sewing head including a first toe seam width guide having a maximum thread guide width of 5 mm, and a second sewing head including a second toe seam width guide, the maximum thread guide width of the second toe seam width guide being in the range of 6–10 mm. An operator manually places the hosiery blank on the hosiery blank conveyor means and conveys the hosiery blank to the first sewing head. The edges of the toe pouch and the hose top portion are aligned in juxtaposed relationship for sewing underneath the first sewing head, and the edges of the toe pouch and the hose top portion are sewn together in a first, narrow seam. The hosiery blank is then conveyed to the second sewing head, where a thread is pulled around the maximum thread guide width of the second toe seam width guide to sew a second seam over the first seam that is wider than the first seam.

In another embodiment, the toe seam width guides are adjustably attached to the sewing heads. The first toe seam width guide position is adjusted and the second toe seam width guide position is adjusted to effect a thread guide width in each sewing head over which the thread is pulled. These adjustments provide corresponding adjustments to the first and second seams and thus to their relative widths. In yet another embodiment, a method of the present invention includes sewing the second seam into a course of yarn beyond the first two courses of yarn at the edges of the toe pouch and the hosiery top portion so as to provide a wider seam than conventional toe seams. In still another embodiment, a method of the present invention includes positioning the second sewing head closer to a hosiery blank than the first sewing head, such that the second seam is sewn in a low profile relative to the hosiery blank and lies flat over the first seam.

Other embodiments of a method for closing a toe of a hosiery blank include providing a toe closing machine having a hem cutting device, conveying the hosiery blank to the hem cutting device, and cutting the hem off of the hosiery blank prior to conveying the blank to the first sewing head. Other embodiments of a method for closing a toe of a hosiery blank include providing a toe closing machine having a yarn-chain cutting device, and after sewing the second seam, conveying the hosiery blank to the yarn-chain cutting device and cutting off the ends of the first and second seams. Preferably, conveying the hosiery blank between the hem cutting device, the first sewing head, the second sewing head, and the yarn chain cutting device on the toe closing machine is performed automatically.

Embodiments include hosiery products made using apparatus and methods according to the present invention. Such hosiery products include, for example, socks, heavy denier tights, and ladies fine denier hosiery. Embodiments of the present invention can be used to provide wide, visible, and strong seams in other items made from sewn fabric and in garments other than hosiery. For example, an apparatus and method of the present invention having a seam width guide can be utilized to sew wide, visible, and strong seams in a shirt sleeve and/or in fabric covers for products such as an umbrella and a golf club.

Features of a hosiery toe closing apparatus and method of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

A hosiery toe closing apparatus and method of the present invention provides numerous advantages over prior means for hosiery toe closure. For example, the present invention advantageously provides a wide, visible seam that is beneficial for branding and marketing of products.

Another advantage is that the present invention provides wider seams that are sewn farther away from edges of fabric so that the resulting seams are stronger than conventional seams. In addition, because seams made according to the present invention are wide, embodiments allow a greater margin for error in sewing a seam.

Another advantage is that the present invention provides a means for adjusting relative widths of multiple seams sewn over other seams, allowing for a range of combinations of seam configurations and widths.

Another advantage is that the present invention provides seams that are sewn with a flat profile and are comfortable to a wearer.

Another advantage is that the present invention provides flexibility in control of seam width and visibility by varying the dimensions of one small, interchangeable component of a conventional automated garment sewing machine. As a result, embodiments of the present invention are cost-effective.

As will be realized by those of skill in the art, many different embodiments of a hosiery toe closing apparatus and method according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

In embodiments of the present invention, an apparatus and method for automated hosiery toe closing comprise a toe closing machine including a sewing head, a vertical needle, a horizontal needle, and a seam width guide. In embodiments, the width of the tongue of the seam width guide provides a toe seam that is advantageously wider, more visible, and stronger than conventional toe seams. FIGS. 1–10 show such embodiments.

Figure 1:
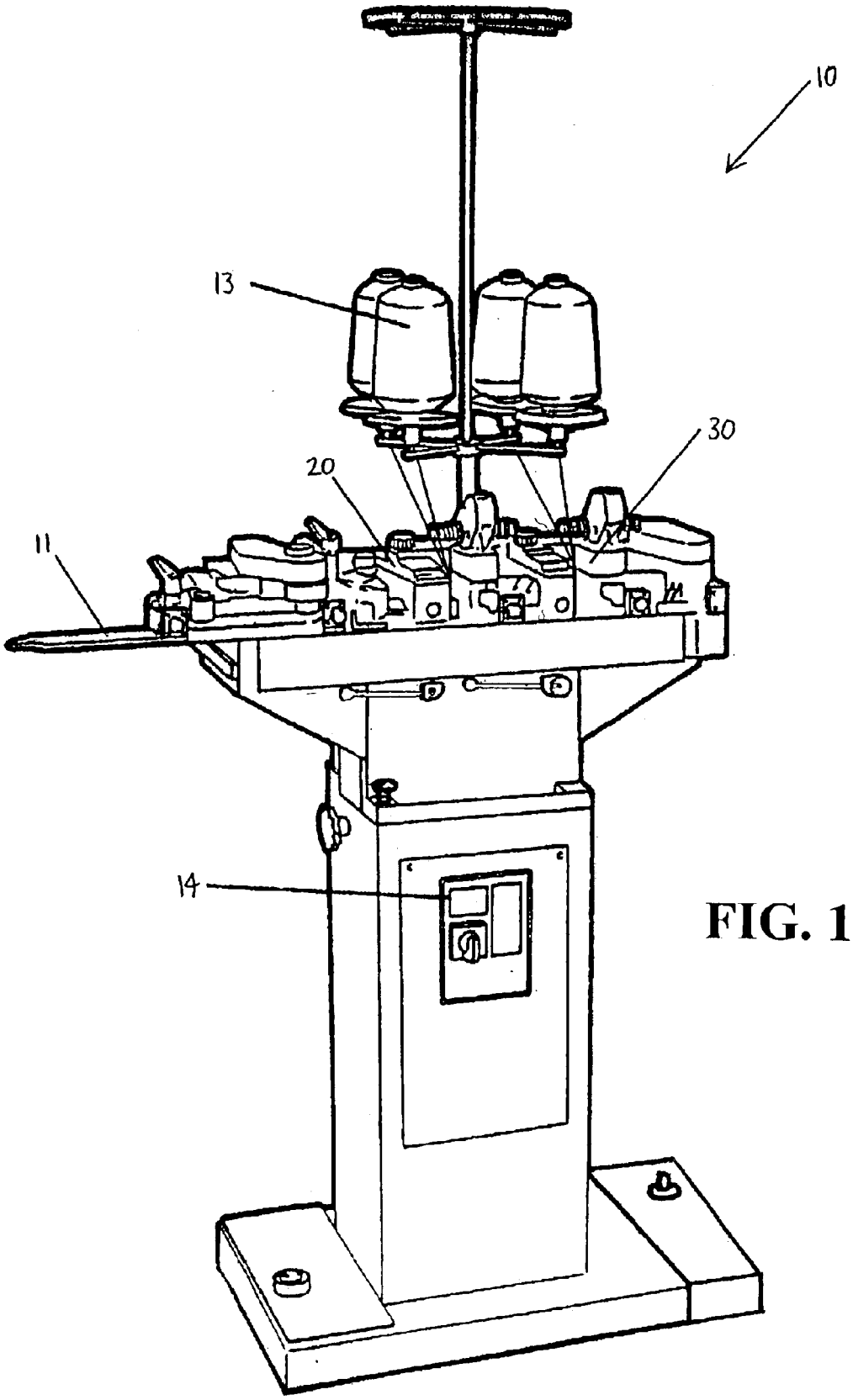
FIG. 1 is a front perspective view of a sock toe closing machine in an embodiment of the present invention.
Figure 7:
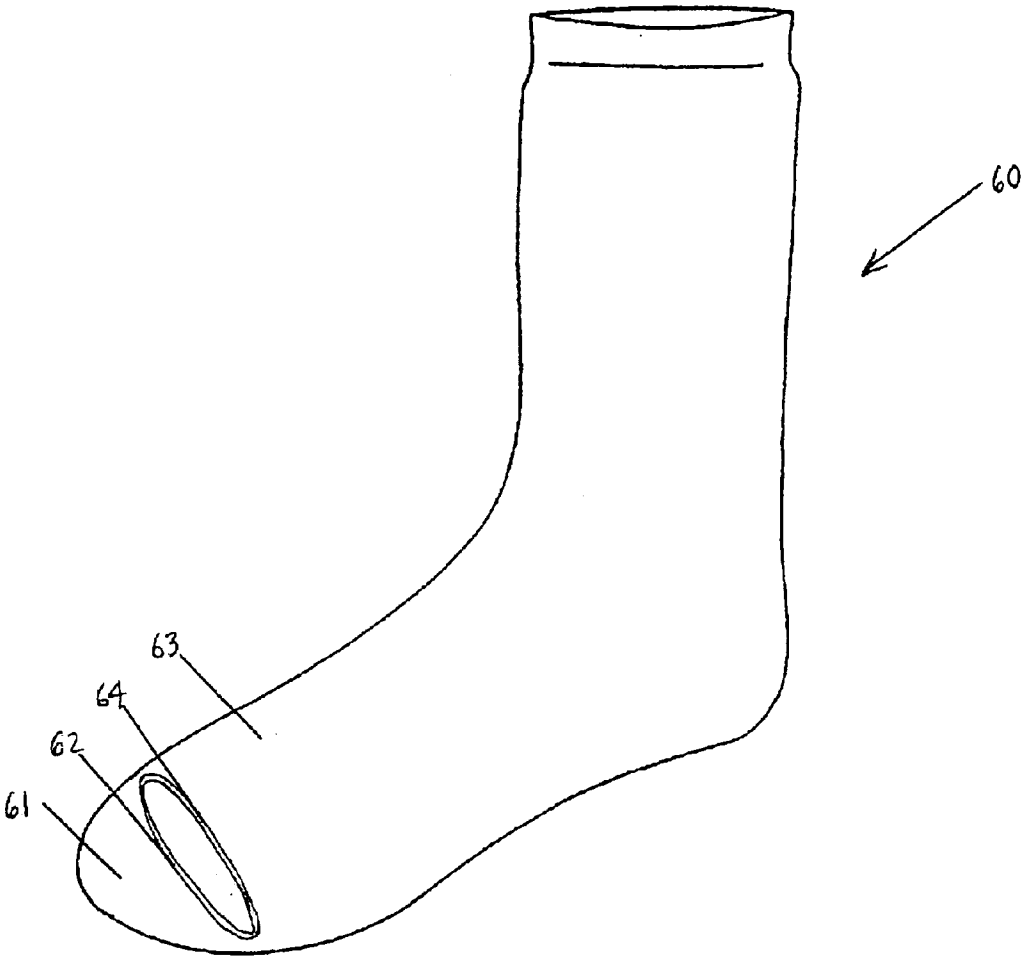
FIG. 7 is a view of a sock showing the edge of a hose top portion and the edge of a toe portion in an embodiment of the present invention.

FIG. 1 shows a sock toe closing machine 10 used in closing sock toes during conventional sock manufacturing processes. The sock toe closing machine 10 includes a conveyor 11 for conveying a sock 60 (as shown in FIG. 7) to first sewing head 20 for sewing a first toe seam. The sock 60 is then automatically transported by the conveyor 11 to a second sewing head 30 for sewing a second toe seam. The sock toe closing machine 10 includes spindles from which thread 13 is routed to each of the sewing heads 20, 30 for sewing seams. The sock toe closing machine 11 is automated, and includes a control panel 14 having switches and controls for each operation of the sock toe closing process.

Figure 8:
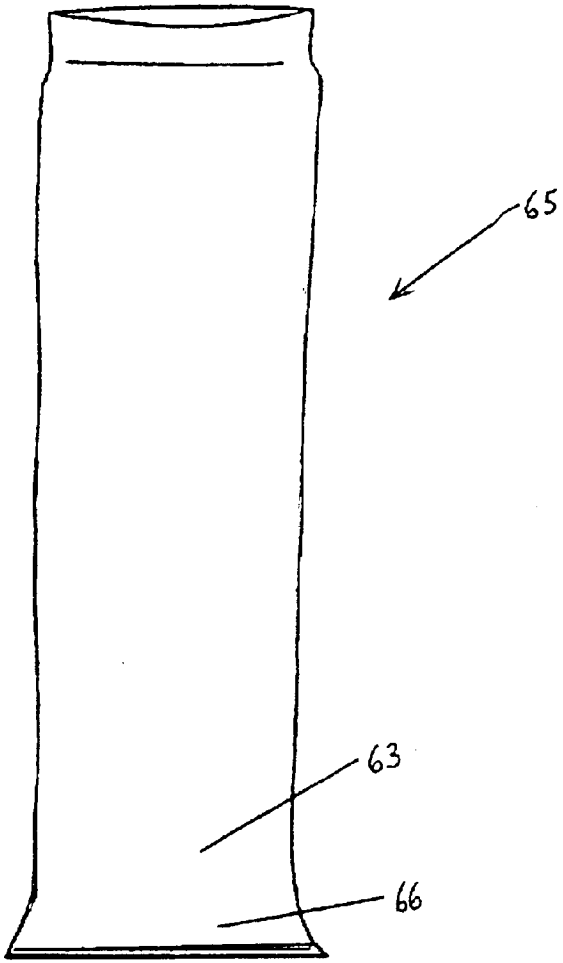
FIG. 8 is a view of a tubular hosiery blank showing a hem clip useful in an embodiment of the present invention.

In conventional hosiery manufacturing processes, hosiery is knitted in a tubular form, as shown in FIGS. 7 and 8. One end of each hosiery tube blank 65 has to be closed to form the toe end. One technique for closing the toe end of the hosiery tube blank 65 involves reciprocating a knitting machine during the knitting operation to form a reciprocated toe or pouch. Reciprocation of a toe pouch results in a gap between the edge 62 of the toe pouch 61 and the edge 64 of the adjacent top portion 63 of the knitted blank 65, as shown in FIG. 7. At the end of the knitting operation of the tubular hosiery blank 65, the edge 62 of the toe pouch 61 and the edge 64 hose top portion 63 are knitted so as to form a "window," having a hem 66, commonly known as a "clip." The hem, or clip, 66 of fabric, as shown in FIG. 8, extends beyond the edges 62, 64, respectively, of the toe pouch 61 and hose top portion 63. The hem clip 66 provides a means for guiding the tubular hose blank 65 into the toe closing machine 10 where the edges 62, 64, respectively, of the toe pouch 61 and hose top portion 63 are permanently sewn together. In this manner, the hosiery toe end is closed with a flat seam that is comfortable to a wearer's toes or foot. Hosiery toe closure can be effected by automatic toe closing machines, such as a Conti Complett 222 Variotronic toe closing machine, similar to the embodiment of the toe closing machine 10 shown in FIGS. 1 and 2.

Figure 2:
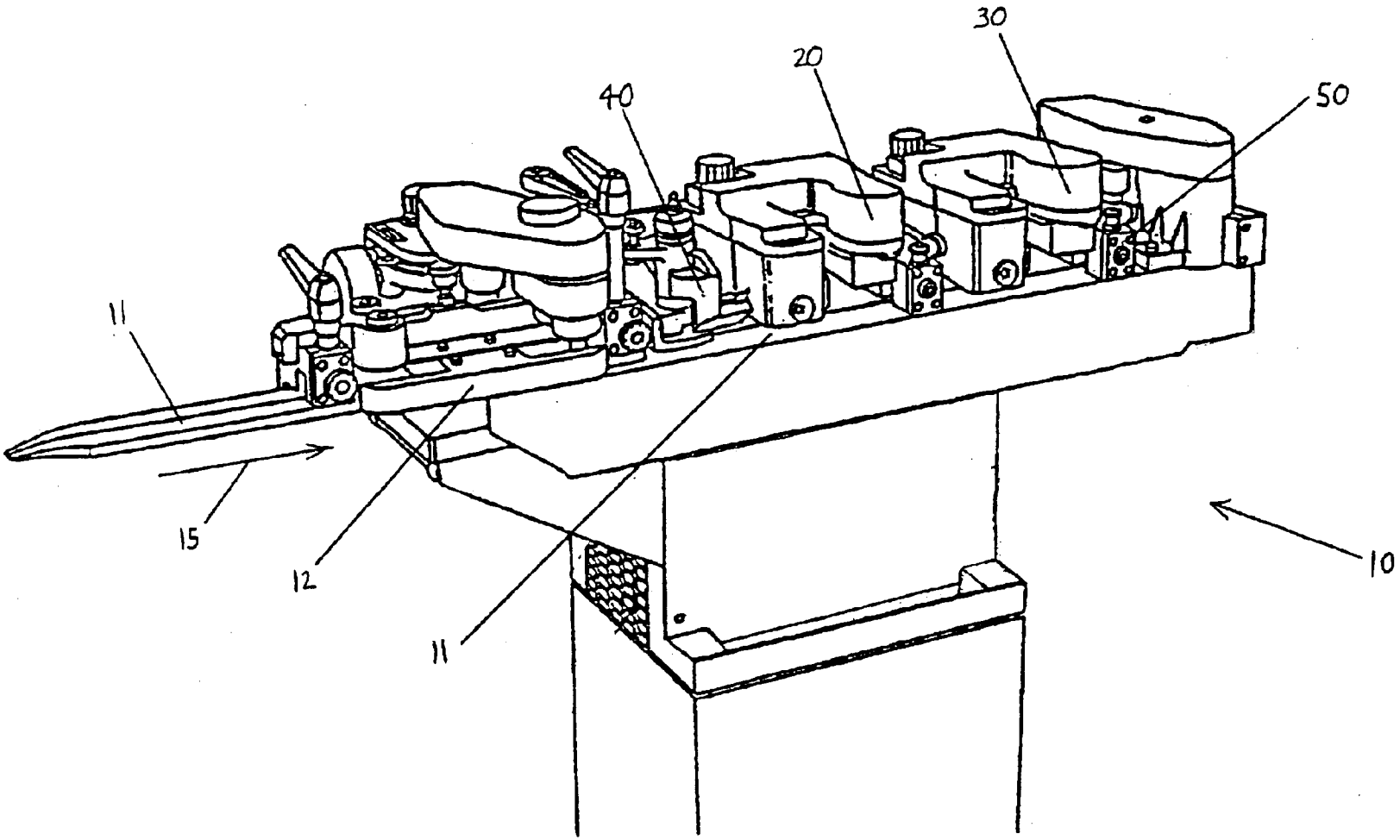
FIG. 2 is a close-up, partial, front perspective view of the sock toe closing machine shown in FIG. 1 in an embodiment of the present invention.

In operation, an operator manually places a sock 60 onto the conveyor 11 of the sock toe closing machine 10, as shown in FIG. 2. The conveyor 11 includes a chain (not shown behind a chain cover 12) that automatically transports the sock tube 60 from one operational station to the next. The sock tube 60 is placed flat on the conveyor 11 with the knitted hem clip 66 in the forward position in the direction of sock movement 15. Automatic conveyance of a hosiery blank into position for sewing a toe closure is described in U.S. Pat. No. 6,026,757 to Valle et al., which is incorporated herein by reference in its entirety. The sock tube 60 is automatically advanced to a predetermined position on the conveyor 11 underneath a hem cutting device 40 where the hem clip 66 is cut off.

Once the hem clip 66 is severed from the sock blank, the conveyor 11 automatically transports the sock tube 60 to a predetermined position underneath the first sewing head 20. The cut edges 62, 64, respectively, of the toe pouch 61 and adjacent hose top portion 62 are automatically aligned in a juxtaposed relationship to be sewn together to close the toe. The juxtaposed edges 62, 64, respectively, of the toe pouch 61 and the hose top portion 63 are automatically positioned and held in place for accurate stitching in a straight line. Such mechanisms for positioning and sewing the toe seam of a hosiery blank have been previously described, for example, in U.S. Pat. No. 4,609,419 to Hodges and in U.S. Pat. No. 4,133,280 to Takatori et al., which are incorporated herein by reference in their entirety.

After the edges 62, 64, respectively, of the toe pouch 61 and hose top portion 63 are sewn together by the first sewing head 20, the conveyor 11 automatically transports the sock 60 to the second sewing head 30. The first seam is automatically aligned into position beneath the second sewing head 30, and the second sewing head 30 sews a second row of stitches over the first seam. Following sewing of the second seam, the conveyor 11 automatically transports the sock 60 to a yarn chain cutting device 50. As described further herein, a seam width guide, or tang, 70 provides a width around which a needle pulls threads along a straight stitch line to form essentially a "tube" of thread in a looped "chain." The yarn chain cutting device 50 cuts the end of the chain of the stitched tube of thread, to complete the sock toe closing process.

Figure 3:
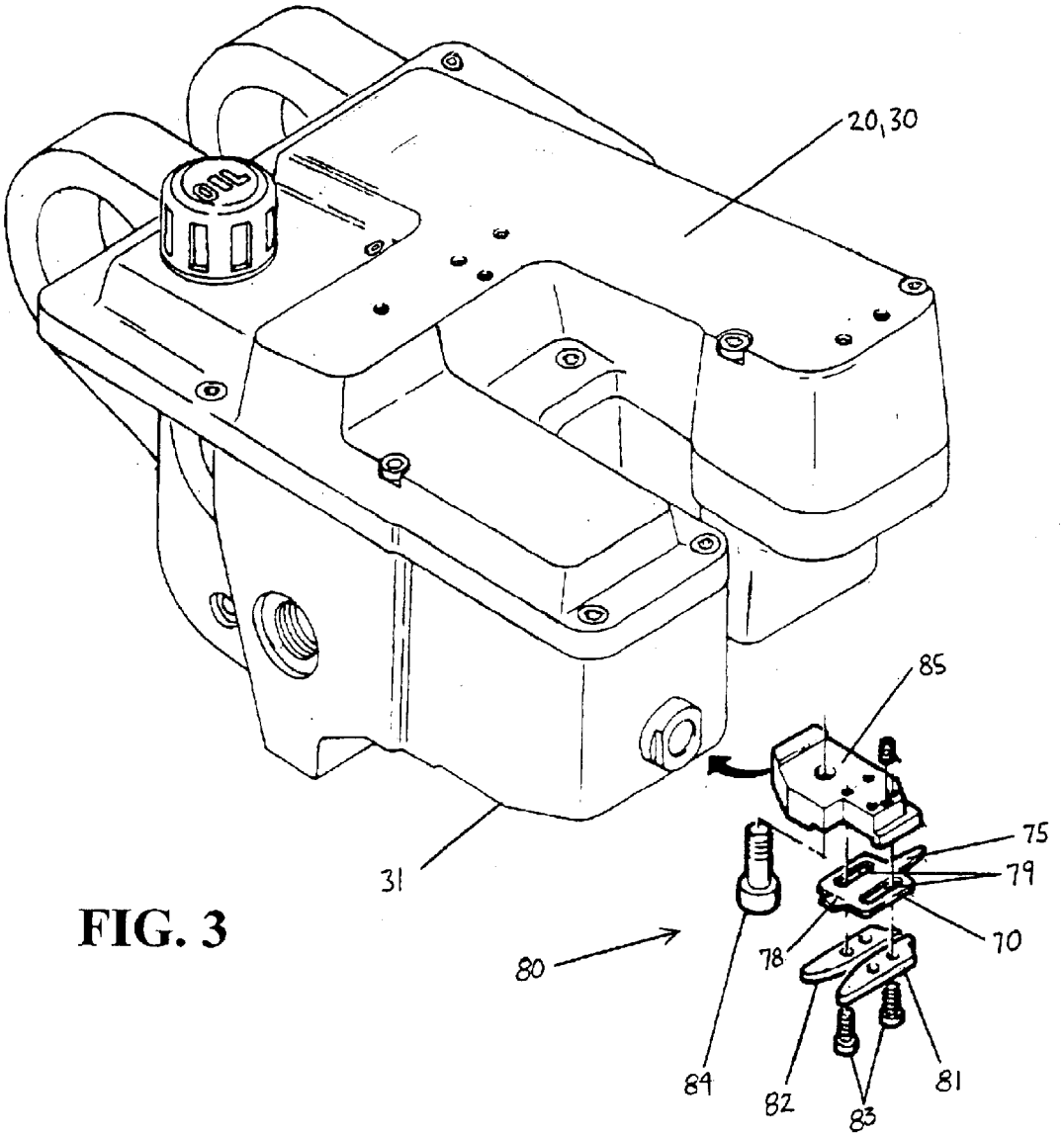
FIG. 3 is a perspective view of a sewing head showing an exploded view of a tang assembly in an embodiment of the present invention.
Figure 4:
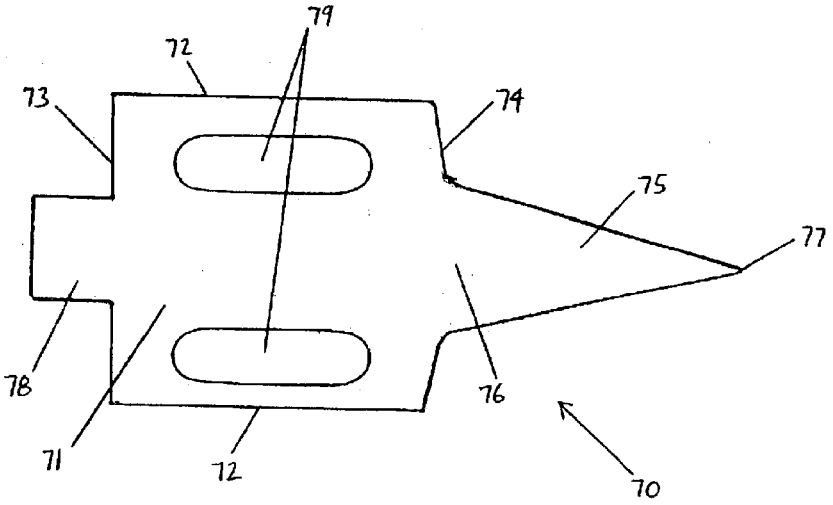
FIG. 4 is a diagrammatic view of a tang in an embodiment of the present invention.

As shown in FIG. 3, the sewing head 20, 30 includes a seam width guide, or tang, assembly 80 mounted (shown by the arrow) to the bottom face 31 of the sewing head 20, 30. In embodiments of the present invention, each sewing head 20, 30 is equipped with a thread chain-forming tang 70. In automated sock toe closing machinery, a tang controls the amount of yarn consumed, or utilized, in making a toe seam. A "tang" is generally defined as "a tongue or prong." In the present invention, as shown in FIG. 4, the seam width guide tang (hereinafter "tang") 70 comprises a substantially flat body 71 having a two sides 72, a front edge 73, and a back edge 74. A tapered tongue 75 extends from the back edge 74 in the same plane as the tang body 71. The tongue 70 includes a tongue base 76 of a predetermined width adjacent to the back edge 74 of the tang body 71. The tongue 75 has a lance-shaped contour and extends at a predetermined angle from the tongue base 76 to its termination point at a tongue tip 77. The tang 70 includes a slightly upwardly bent flange 78 extending from the front edge 73. The tang 70 further includes a mounting slot 79 for adjustably connecting the tang 70 to a tang holding block 85 with mounting screws 83. The tang holding block 85 is in turn mounted onto the bottom face 31 of the sewing heads 20, 30 with adjusting screw 84, as shown in FIG. 3. Preferably, the tang 70 includes two mounting slots 79, one mounting slot 79 on each side 72 of the tang 70.

A front sock guide 81 and a rear sock guide 82 are connected to the tang holding block 85 by inserting the mounting screws 83 through screw holes in the front and rear sock guides 81, 82 and through the tang mounting slots 79 into the tang holding block 85. The mounting slots 79 allow adjustment of the tang 70 forward and rearward, which varies the effective width of the tang tongue 75 around which thread 13 is sewn, and thus the width of the seam. The tang 70 may be adjusted between a fully forward position, with the mounting screws 83 located as close as possible to the tang back edge 74, and a fully rearward position, with the mounting screws 83 located as close as possible to the front edge 73 of the tang 70. When the tang 70 is in the most forward position, threads 13 carried by the needles move across the widest part of the tongue base 76 to provide the widest seam available from a particular tongue base width. When the tang 70 is in the most rearward position, threads 13 carried by the needles move across a more narrow part of the tongue 75 near the tongue tip 77 to provide the most narrow seam available from a particular tang tongue. Generally, the tang 70 is maintained in its most forward, or fully extended, position so that the widest part of the tang tongue 75 is utilized for determining scam width.

As the sock 60 moves toward the sewing heads 20, 30, the sock 60 is guided such that it is centered under the sewing heads 20, 30 by the front and rear sock guides 81, 82, respectively, underneath the tang 70. Loose yarn ends of the cut edges 62, 64, respectively, of the toe pouch 61 and/or hose top portion 63 and any excess fabric extending from the cut edges 62, 64 can protrude upward out of alignment with the sewing heads 20, 30. The front and rear sock guides 81, 82, respectively, guide loose ends of the cut edges 62, 64, respectively, of the toe pouch 61 and the hose top portion 63 downward under the tang 70 for proper alignment underneath the sewing heads 20, 30.

Figure 10:
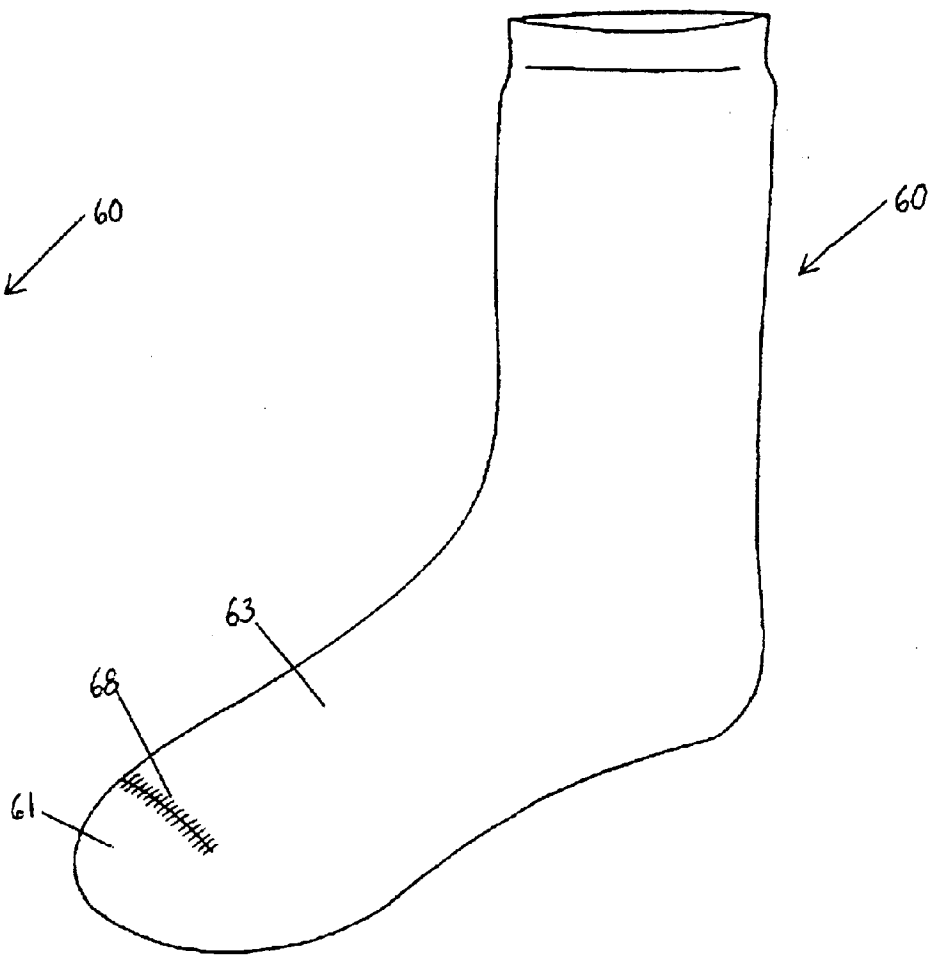
FIG. 10 is a view of a sock illustrating a wide toe seam in an embodiment of the present invention.
Figure 9:
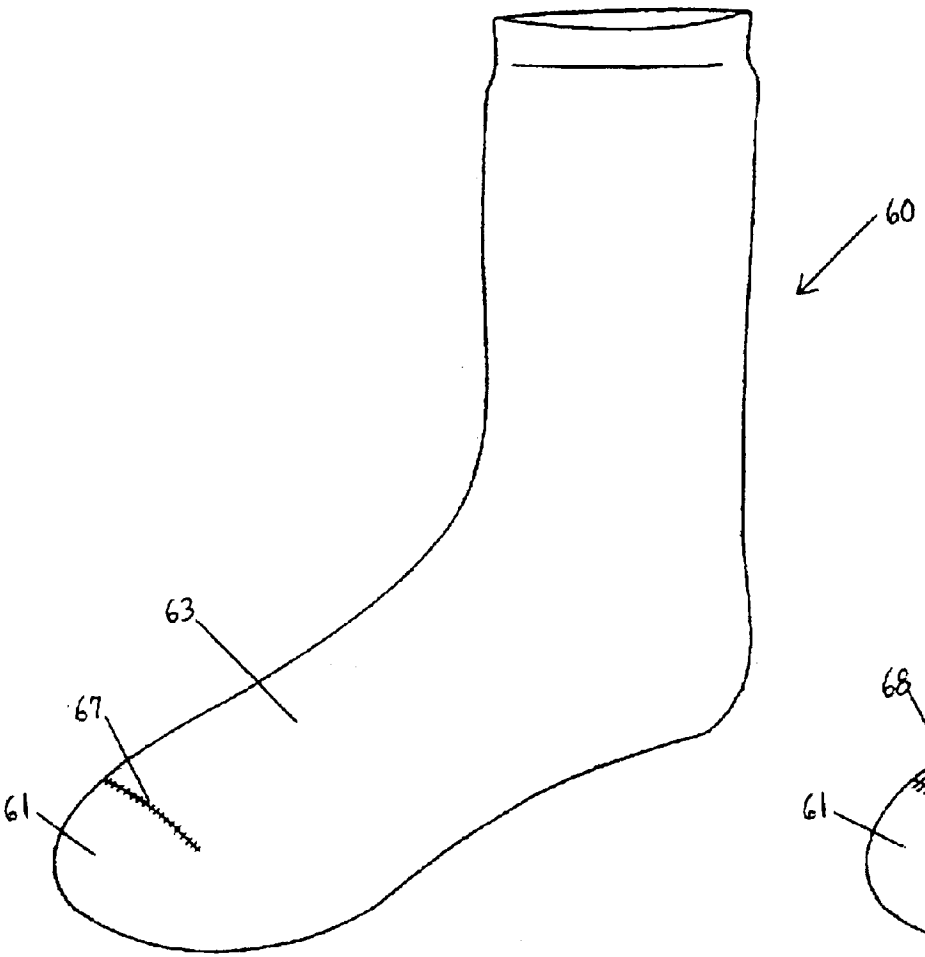
FIG. 9 is a view of a sock illustrating a narrow toe seam.

The tongue base 75 of a conventional seaming tang 70 is 5 mm wide. Toe seam threads 13 guided by a 5 mm wide tang are typically sewn into the outermost one or two courses of yarn on each cut edge 62, 64, respectively, of the toe pouch 61 and hose top portion 63 of the sock 60, resulting in a narrow toe seam 67 that is difficult to see. FIG. 9 shows one such narrow seam 67. In embodiments of the present invention, a tang 70 tongue base 76 comprises a width of between 6 and 10 mm, which is wider than conventional tangs. In a preferred embodiment, the tang 70 tongue base 76 has a width of 7 mm. A tang 70 having a wider tongue base 76 allows threads 13 to be pulled by the horizontal needle across the tang 70 a distance such that the threads 13 are stitched into courses of yarn farther into the sock 60 away from the edges 62, 64, respectively, of the toe pouch 61 and hose top portion 63. The result is a greater distance apart from edge to edge of the resulting seam. For example, a 7 mm wide tongue base 76 provides an approximately 7 mm wide seam. Thus, a wider tang tongue 75 forms a wider, more visible seam 68, as shown in FIG. 10.

In embodiments of the present invention, the first sewing head 20 includes a tang 70 having a maximum tongue base 76 width of 5 mm. The second sewing head 30 includes a tang 70 having a wider maximum tongue base 76, for example, between 6 and 10 mm. In preferred embodiments, the tang 70 of the second sewing head 30 comprises a tongue base 76 width of 7 mm. The first sewing head 20 sews the narrow, flat seam 67. The second sewing head 30 then sews a wider, flat seam that increases the total seam strength. In addition, the second sewing head 30 is 0.4 mm lower than the first sewing head 20, which allows the second sewing head 30 to provide a flatter second seam across the top of the first seam. Threads having particular colors are sewn with the vertical needle on the second sewing head to provide a distinct and readily visible toe seam.

Figure 5:
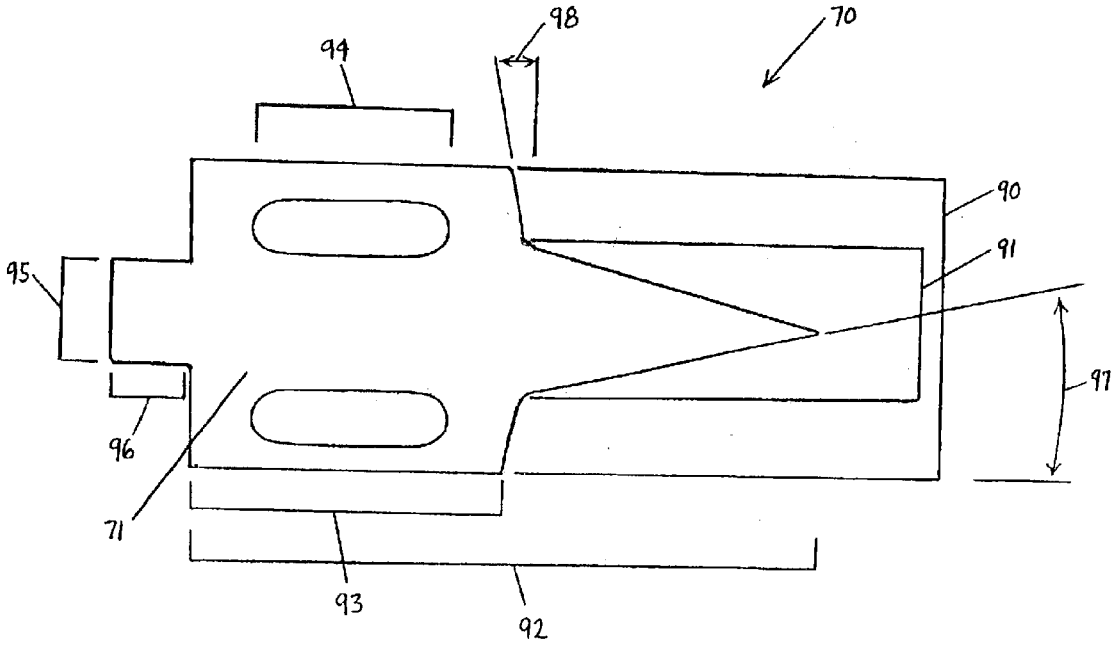
FIG. 5 is a diagrammatic view of a tang showing dimension specifications in an embodiment of the present invention.

In one embodiment of the present invention, an apparatus for hosiery toe closing that provides a wide seam includes a tang 70 as shown in FIG. 5. The tang 70 is made according to the specifications in Table 1, and is suitable for use on a Conti Complett 222 Variotronic toe closing machine.

TABLE 1

Tang Specifications

| Measurement | Dimension |
|---|---|
| Side to Side Width (90) | 0.625–0.630 inches (in.) |
| Tongue Base Width (91) | 0.295 in |
| Front Edge to Tongue Tip Length (92) | 1.30 in. |

TABLE 1-continued

Tang Specifications

| Measurement | Dimension |
|---|---|
| Front Edge to Back Edge Length (93) | 0.680 in. |
| Slot Length (94) | 0.510 in. |
| Flange Width (95) | 0.200 in. |
| Flange Length (96) | 0.125 in. |
| Flange Height | 0.080 in. |
| Tang Thickness | 0.020 +/− 0.001 in. |
| Tongue Tip Radius | 0.030 in. |
| Side-Tongue Angle (97) | 13.5 degrees |
| Back Edge Angle (98) | 15.0 degrees |

Figure 6:
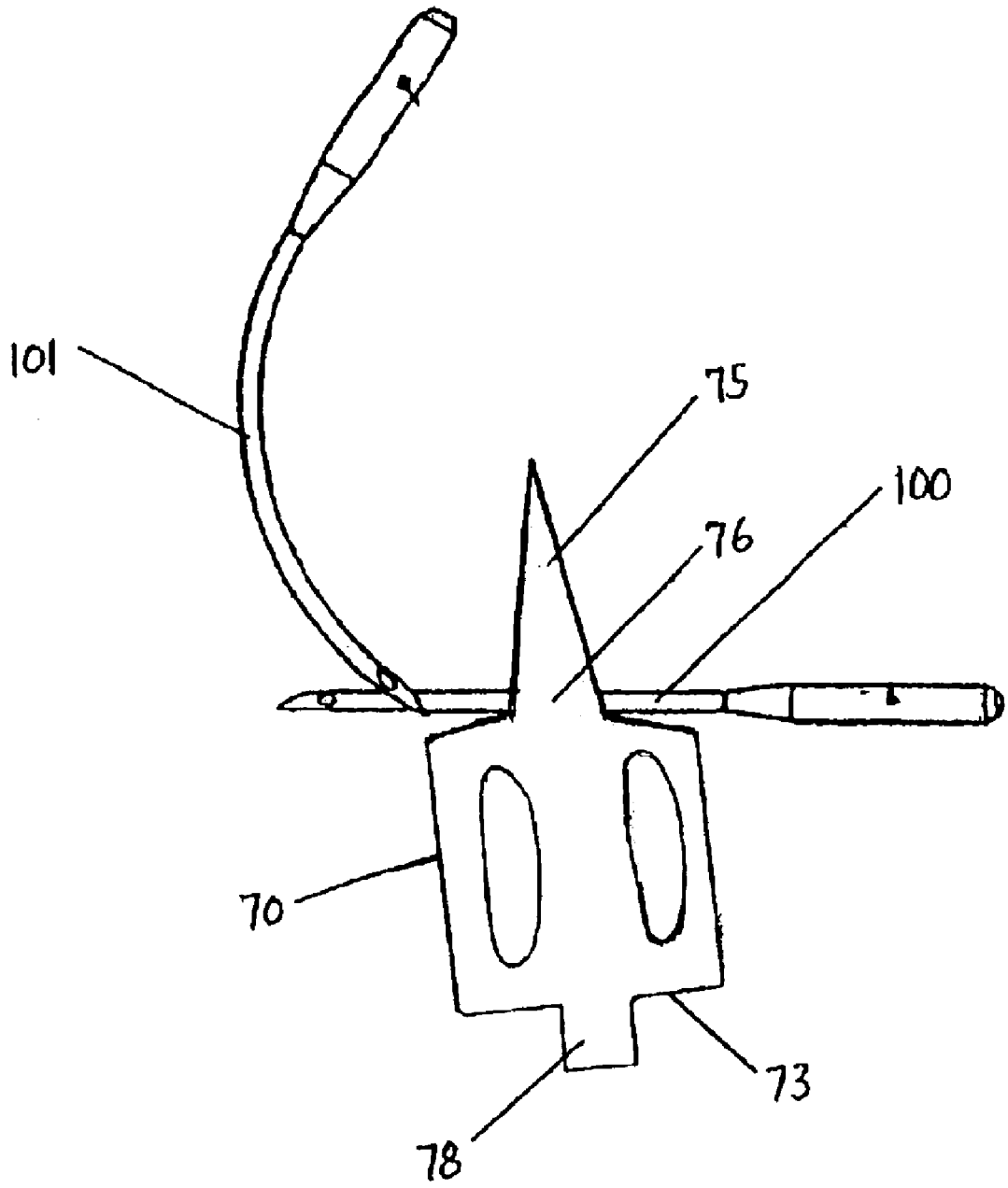
FIG. 6 is a diagrammatic view illustrating the relative spatial relationships of a vertical needle, a horizontal needle, and a tang in an embodiment of the present invention.

In the automated sock toe closing machine 10, two needles, a horizontal needle 100 and a vertical needle 101 (as shown in FIG. 6), are used in forming the toe seam of the sock 60. Each needle 100, 101 has an eye through which a thread is carried. Each needle 100, 101 carries a separate thread. The horizontal needle 100 is positioned above the two juxtaposed cut edges 62, 64, respectively, of the toe pouch 61 and hose top portion 63. In operation, the horizontal needle 100 extends in an arc in a plane substantially parallel to and below the tang 70 to pull a thread 13 underneath the tang 70. When the horizontal needle 100 is fully extended such that the eye of the needle is positioned at a point approximately above one intended edge of a seam, the vertical needle 101 extends downwardly in an arc to penetrate between courses of yarn in the sock 60. The point of the vertical needle 101 moves between the horizontal needle 100 and the thread 13 carried by the horizontal needle 100, catches the horizontal thread, and slides the horizontal thread over the back of the horizontal needle 100. At the point where the vertical needle 101 catches the horizontal thread, the thread carried by the vertical needle 101 is pulled around the horizontal thread to form an interlocking loop. The vertical needle 101 then moves upward back through the one edge of the sock toe opening, forming one edge of a seam.

The horizontal needle 100 then retracts such that the eye of the needle 100 is positioned at a point approximately above the intended opposite edge of the seam. Because the horizontal thread and the vertical thread are interlocked in a loop, both threads 13 are pulled by the horizontal needle 100 to the retracted position. When both threads 13 are in the retracted horizontal position, the vertical needle 101 again extends downwardly in an arc to penetrate between courses of yarn in the sock. The point of the vertical needle 101 moves between the horizontal needle 100 and the thread 13 carried by the horizontal needle 100, catches the horizontal thread, and slides the horizontal thread over the back of the horizontal needle 100. At the point where the vertical needle 101 catches the horizontal thread, the thread 13 carried by the vertical needle is pulled around the horizontal thread to form an interlocking loop. The vertical needle 101 then moves upward back through the opposite edge of the sock toe opening, forming the opposite edge of a seam.

This pattern of the horizontal needle 100 moving to its extended and retracted positions in coordination with movement of the vertical needle 101 downward and upward to form interlocking loops is repeated for a predetermined length to pull the edges 62, 64, respectively, of fabric of the toe pouch 20 and hose top portion 30 together and form a seam.

As the horizontal needle 100 moves out and back from its extended and retracted positions, the horizontal thread and the interlocked vertical thread are carried over the top of the tang 70. The tang 70 provides a width around which the threads 13 are pulled by the horizontal needle 100, essentially forming a chain of thread in a tube-like shape. The width of the tang 70 tongue 75 at which the threads 13 are pulled by the horizontal needle 100 as the threads 13 are interlocked determines the spacing between the outer edges, and thus the width, of the resulting seam.

In embodiments of the present invention, the tang 70 comprises a material capable of withstanding repeated use and scarring from broken needles, yet sufficiently flexible so as to bend slightly to accommodate sock movement and not break. For example, in a preferred embodiment, a 1070 or 1095 spring steel blank is stamp-cut using a precision die. The tang 70 is then heat-treated to achieve a hardness of 56–58 on a standard Rockwell hardness scale to achieve the desired strength/flexibility balance.

Embodiments of the present invention include methods of hosiery toe closing. For example, embodiments include a method for closing a toe of a hosiery blank 65 including the steps of providing a hosiery toe closing machine 10 comprising a hosiery blank conveyor means 11, a hosiery blank alignment means, a first sewing head 20 including a first toe seam width guide, or tang, 70 having a maximum thread guide width of 5 mm, and a second sewing head 30 including a second toe seam width guide, or tang, 70, the maximum thread guide width of the second toe seam tang 70 being in the range of 6–10 mm. An operator manually places the hosiery blank 65 on the hosiery blank conveyor means 11 and conveys the hosiery blank 65 to the first sewing head 20. The edges 62, 62, respectively, of the toe pouch 61 and the hose top portion 63 are aligned in juxtaposed relationship for sewing underneath the first sewing head 20, and the edges 62, 63, respectively, of the toe pouch 61 and the hose top portion 63 are sewn together in a first, narrow seam 67. The hosiery blank 65 is then conveyed to the second sewing head 30, where a thread 13 is pulled around the maximum thread guide width of the second toe seam tang 70 to sew a second seam 68 over the first seam 67 that is wider than the first seam 67.

In another embodiment, the toe seam width guides 70 are adjustably attached to the sewing heads 20, 30. The position of the first toe seam tang 70 is adjusted and the position of the second toe seam tang 70 is adjusted to effect a thread guide width in each sewing head 20, 30 over which the thread is pulled. These adjustment provide corresponding adjustments to the first and second seams 67, 68, respectively, and thus to their relative widths. In yet another embodiment, a method of the present invention includes sewing the second seam 68 into a course of yarn beyond the first two courses of yarn at the edges 62, 64, respectively, of the toe pouch 61 and the hosiery top portion 63 so as to provide a wider seam than conventional toe seams. In still another embodiment, a method of the present invention includes positioning the second sewing head 30 closer to a hosiery blank 65 than the first sewing head 20, such that the second seam 68 is sewn in a low profile relative to the hosiery blank 65 and lies flat over the first seam 67.

Other embodiments of a method for closing a toe of a hosiery blank 65 include providing a toe closing machine 10 having a hem cutting device 40, conveying the hosiery blank 65 to the hem cutting device 40, and cutting the hem clip 66 off of the hosiery blank 65 prior to conveying the blank 65 to the first sewing head 20. Other embodiments of a method for closing a toe of a hosiery blank 65 include providing a toe closing machine 10 having a yarn-chain cutting device 50, and after sewing the second seam 68, conveying the hosiery blank 65 to the yarn-chain cutting device 50 and cutting off the ends of the first and second seams 67, 68, respectively. Preferably, conveying the hosiery blank 65 between the hem cutting device 40, the first sewing head 20, the second sewing head 30, and the yarn chain cutting device 50 on the toe closing machine 10 is performed automatically.

Embodiments of the present invention include hosiery products made by such apparatus and methods. Hosiery products, such as socks 60, heavier denier tights, and ladies fine denier hosiery, for example, can be made using an automated toe closing apparatus including a tang 70 having a wide tongue base 76. In embodiments, a tang 70 having a tongue base 76 width of 7 mm produces socks, for example the sock shown in FIG. 10, as well as other hosiery products, that have a wide, more visible seam. Embodiments of socks 60 and other hosiery products of the present invention include a wide, visible, and strong seam 68 that is produced in the manner described herein such that the seam is flat and comfortable to a wearer.

Embodiments of the present invention can be used to provide wide, visible, and strong seams in other items made from sewn fabric and in garments other than hosiery. For example, an apparatus and method of the present invention having a seam width guide can be utilized to sew wide, visible, and strong seams in a shirt sleeve and/or in fabric covers for products such as an umbrella and a golf club.

Although the present invention has been described with reference to particular embodiments, it should be recognized that these embodiments are merely illustrative of the principles of the present invention. Those of ordinary skill in the art will appreciate that a hosiery toe closing apparatus and method of the present invention may be constructed and implemented in other ways and embodiments. Accordingly, the description herein should not be read as limiting the present invention, as other embodiments also fall within the scope of the present invention.

What is claimed is:

1. An apparatus for producing a wide seam, comprising:

a sewing device including a first sewing head and a second sewing head, each sewing head having a sewing needle;

a seam width guide attached to each sewing head;

the first sewing head having a maximum thread guide width of 5 mm;

the second sewing head having a maximum thread guide width of greater than 5 mm, wherein when the first sewing needle pulls a thread around the maximum thread guide width of the first sewing head, a first, narrow seam is sewn, and wherein when the second sewing head sewing needle pulls a thread around the maximum thread guide width of the second sewing head, a second seam is sewn over the first seam that is wider than the first seam.

2. The apparatus of claim 1, wherein the seam width guide is adjustably attached to the sewing head for adjusting an effective thread guide width over which the sewing needle pulls the thread.

3. A hosiery toe closing apparatus, comprising:

a hosiery toe closing machine including a first sewing head and a second sewing head, each sewing head having a sewing needle and a toe seam width guide attached to the respective sewing head;

the first sewing head, having a maximum thread guide width of 5 mm; and the second sewing head having a maximum thread guide width of greater than 5 mm, wherein when the first sewing head sewing needle pulls a thread around the maximum thread guide width of the first sewing head, a first, narrow seam is sewn, and wherein when the second sewing head sewing needle pulls a thread around the maximum thread guide width of the second sewing head, a second seam is sewn over the first seam that is wider than the first seam.

4. The apparatus of claim 3, wherein the second seam lies flat over the first seam.

5. The apparatus of claim 4, wherein the second sewing head is positioned closer to a hosiery blank than the first sewing head to produce the flat second seam over the first seam.

6. The apparatus of claim 3, wherein the maximum thread guide width of the toe seam width guide of the second sewing head comprises a width in the range of 6–10 mm.

7. The apparatus of claim 6, wherein the maximum thread guide width of the toe seam width guide of the second sewing head comprises a width of 7 mm.

8. The apparatus of claim 3, wherein the toe seam width guide is adjustably attached to the sewing head for adjusting an effective thread guide width over which the sewing needle pulls the thread.

9. The apparatus of claim 3, wherein the toe seam width guide comprises a tang having a tapered tongue.

10. The apparatus of claim 9, wherein the maximum thread guide width comprises a base of the tongue of the tang.

11. An apparatus for closing a toe of a hosiery blank having a toe pouch with an edge and a hosiery top portion with an edge, comprising;

a hosiery toe closing machine including a sewing head having a sewing needle; and a toe seam width guide having a maximum thread guide width greater than 5 mm, the toe seam width guide attached to the sewing head, wherein when the sewing needle pulls a thread around the maximum thread guide width of the toe seam width guide, the hosiery toe is closed with a wide, visible seam, and wherein the seam is sewn into a course of yam beyond the first two courses of yarn at the toe pouch edge and at the hosiery top portion edge.

12. An apparatus for closing a toe of a hosiery blank having a toe pouch with an edge and a hosiery top portion with an edge comprising:

a hosiery toe closing machine including a sewing head having a sewing needle;

a toe seam width guide having a maximum thread guide width greater than 5 mm, the toe seam width guide attached to the sewing head;

a hosiery blank alignment means for aligning the edge of the toe pouch and the edge of the hose top portion in juxtaposed relationship for sewing underneath the sewing head; and a first sewing head, a second sewing head, and a conveyor for automatically transporting the hosiery blank between the first sewing head and the second sewing head;

wherein when the sewing needle pulls a thread around the maximum thread guide width of the toe seam width guide, the hosiery toe is closed with a wide, visible seam.

13. A method for closing a toe of a hosiery blank, comprising:

providing a hosiery toe closing machine comprising a first sewing head having a sewing needle and a toe seam width guide having a maximum thread guide width of 5 mm, and a second sewing head having a sewing needle and a toe seam width guide having a maximum thread guide width of greater than 5 mm;

sewing a first, narrow seam with the first sewing head; and sewing a second seam over the first seam that is wider than the first seam.

14. A hosiery product made by the process claimed in claim 21.

15. The hosiery product of claim 14, wherein the hosiery product comprises a sock.

16. The method of claim 13, wherein the maximum thread guide width of the toe seam width guide of the second sewing head comprises a width in the range of 6–10 mm.

17. The method of claim 16, wherein the maximum thread guide width of the toe seam width guide of the second sewing head comprises a width of 7 mm.

18. A hosiery product made by the process claimed in claim 16.

19. The hosiery product of claim 18, wherein the hosiery product comprises a sock.

20. The method of claim 13, wherein the toe seam width guide is adjustably attached to the sewing head, further comprising adjusting a position of the toe seam width guide to effect a thread guide width over which the sewing needle pulls the thread.

21. A method for closing a toe of a hosiery blank, the hosiery blank having a toe pouch with an edge and a hosiery top portion with an edge and each edge comprising a plurality of courses of yarn, the method comprising:

providing a hosiery toe closing machine comprising a sewing head including a sewing needle and a toe seam width guide having a maximum thread guide width greater than 5 mm, the toe seam width guide attached to the sewing head;

pulling a thread with the sewing needle around the maximum thread guide width of the toe seam width guide; and sewing the seam into a course of yarn beyond the first two courses of yarn at the toe pouch edge and at the hosiery top portion edge to close the hosiery blank toe with a wide, visible toe seam.

22. The method of claim 13, further comprising positioning the second sewing head closer to the hosiery blank than the first sewing head, wherein the second seam lies flat over the first seam.

23. A method for closing a toe of a hosiery blank, the hosiery blank comprising a toe pouch with an edge and a hosiery top portion with an edge, the method comprising:

providing a hosiery toe closing machine comprising a sewing head including a sewing needle and a toe seam width guide having a maximum thread guide width greater than 5 mm, the toe seam width guide attached to the sewing head, and a hosiery blank alignment means;

aligning the edge of the toe pouch and the edge of the hose top portion in juxtaposed relationship for sewing underneath the sewing head; and pulling a thread with the sewing needle around the maximum thread guide width of the toe seam width guide to close the hosiery toe with a wide, visible toe seam.

24. A method for closing a toe of a hosiery blank, the hosiery blank having a toe pouch with an edge and a hosiery top portion with an edge, the method comprising:

providing a hosiery toe closing machine comprising a hosiery blank conveyor means, a hosiery blank alignment means, a first sewing head including a first toe seam width guide having a maximum thread guide width of 5 mm, and a second sewing head including a second toe seam width guide, the maximum thread guide width of the second toe seam width guide being in the range of 6–10 mm;

placing the hosiery blank on the hosiery blank conveyor means;

conveying the hosiery blank to the first sewing means;

aligning the edge of the toe pouch and the edge of the hose top portion in juxtaposed relationship for sewing underneath the first sewing head;

sewing together the edge of the toe pouch and the edge of the hose top portion with the first sewing head in a first, narrow seam to close the hosiery blank toe;

conveying the hosiery blank to the second sewing head; and pulling a thread around the maximum thread guide width of the second toe seam width guide to sew with the second sewing head a second seam over the first seam that is wider than the first seam to further close the hosiery blank toe.

25. The method of claim 24, wherein the first toe seam width guide is adjustably attached to the first sewing head and the second toe seam width guide is adjustably attached to the second sewing head, the method further comprising adjusting a first toe seam width guide position and a second toe seam width guide position to effect a thread guide width in each sewing head over which the thread is pulled.

26. The method of claim 24, further comprising positioning the second sewing head closer to the hosiery blank than the first sewing head, wherein the second seam lies flat over the first seam.

27. The method of claim 24, each edge comprising a plurality of courses of yarn, the method further comprising sewing the second seam into a course of yarn beyond the first two courses of yarn at the toe pouch edge and at the hosiery top portion edge.

28. The method of claim 24, wherein the hosiery blank further comprises a hem at the edges of the toe pouch and the hose top portion, wherein providing a hosiery toe closing machine further includes providing a hem cutting device, the method further comprising conveying the hosiery blank to the hem cutting device and cutting the hem off of the hosiery blank prior to conveying the hosiery blank to the first sewing head.

29. The method of claim 24, wherein the first and second seams comprise ends, wherein providing a hosiery toe closing machine further includes providing a yarn-chain cutting device, the method further comprising, after sewing the second seam, conveying the hosiery blank to the yarn-chain cutting device and cutting off the ends of the first and second seams.

30. The method of claim 24, wherein conveying the hosiery blank between the hem cutting device, the first sewing head, the second sewing head, and the yarn chain cutting device on the toe closing machine is performed automatically.

* * * * *